US005706632A

United States Patent [19]

Kivits et al.

[11] Patent Number: 5,706,632

[45] Date of Patent: Jan. 13, 1998

[54] METHOD FOR OBTAINING AN OUTPUT STREAM OF MUTUALLY DIFFERENT GRAPHIC PRODUCTS IN A DESIRED ORDER, FOR INSTANCE SORTED ACCORDING TO ADDRESS CODE, AND APPARATUS FOR PRACTICING SUCH METHOD

[75] Inventors: Petrus Franciscus Kivits, Schiedam; Ronald Timmerman, Zaanstad, both of Netherlands

[73] Assignee: Buhrs-Zaandam B.V., Zaandam, Netherlands

[21] Appl. No.: 569,345

[22] Filed: Dec. 8, 1995

[30] Foreign Application Priority Data

Dec. 9, 1994 [NL] Netherlands ..... 9402096

[51] Int. Cl.[6] ..... B65B 35/10

[52] U.S. Cl. ..... 53/443; 53/147; 53/168; 53/493; 271/3.19; 271/302

[58] Field of Search ..... 53/52, 55, 168, 53/202, 203, 501, 147, 154, 411, 461, 443, 445, 493, 131.1, 131.4; 271/3.19, 7, 8.1, 9.13, 69, 202, 270, 302, 303

[56] References Cited

U.S. PATENT DOCUMENTS

| | | | |
|---|---|---|---|
| 4,683,708 | 8/1987 | Linder | 53/168 X |
| 4,790,119 | 12/1988 | McDaniels | 53/461 X |
| 5,025,610 | 6/1991 | Graushar . | |
| 5,099,633 | 3/1992 | Gombault et al. | 53/411 |
| 5,113,639 | 5/1992 | Bryson | 53/168 X |
| 5,189,863 | 3/1993 | Pozzi | 53/461 X |
| 5,414,974 | 5/1995 | Van de Ven et al. | 53/168 X |

FOREIGN PATENT DOCUMENTS 0 611 665 8/1994 European Pat. Off. .

OTHER PUBLICATIONS

Patent Abstracts of Japan, vol. 7, No. 59, Mar. 11, 1983, #57-203611 of Hiroshi Ooba, "Article Conveyor".

*Primary Examiner*—Daniel Moon

*Attorney, Agent, or Firm*—Griffin, Butler, Whisenhunt & Kurtossy

[57] ABSTRACT

A method for obtaining an output stream of mutually different graphic products in a desired order, for instance sorted according to address code, wherein the products are assembled in an assembly line as desired by an addressee and/or a sender, and after the assembly line the product undergoes at least one additional operation, depending upon the desire of the addressee and/or sender, for which purpose the product stream is divided over at least two sublines in which the or each additional operation, such as for instance packaging, is carried out, whereafter the products are merged again in a single downstream line, characterized in that, for the purpose of avoiding buffers, the order of the products (2) that are formed in the assembly line (3) is such that, allowing for the desired additional operations in the sublines (9, 10), the products, after traversing the sublines, have acquired the desired order in the downstream line (14, 15), while the products in the sublines (9, 10) can be temporarily delayed and/or stopped, depending upon the desired order of the output product stream.

4 Claims, 1 Drawing Sheet

METHOD FOR OBTAINING AN OUTPUT STREAM OF MUTUALLY DIFFERENT GRAPHIC PRODUCTS IN A DESIRED ORDER, FOR INSTANCE SORTED ACCORDING TO ADDRESS CODE, AND APPARATUS FOR PRACTICING SUCH METHOD

This invention relates to a method for obtaining an output stream of mutually different graphic products in a desired order, for instance sorted according to address code, wherein the products are assembled in an assembly line as desired by an addressee and/or a sender, and after the assembly line the product undergoes at least one additional operation depending upon the desire of the addressee and/or sender, for which purpose the product stream is divided over at least two sublines in which the or each additional operation, such as for instance packaging, is carried out, whereafter the products are merged again in a single downstream line.

BACKGROUND OF THE INVENTION

Such a method is known from U.S. Pat. No. 5,025,610, where products that are to be wrapped are taken off a conveyor and wrapped in a side strewn. Thereafter the wrapped products are placed back in the empty positions on the conveyor. Since the position of a removed product is filled up by a different wrapped product, it is necessary to maintain at least one intermediate stock. In practice, an intermediate stock is used both before and after the packaging machine. Due to these intermediate stocks, the ratio between the number of wrapped and unwrapped products cannot be chosen randomly.

A further disadvantage of this method is that a minimum number of products must be present in the intermediate stock or buffer. This method is riot suitable for packaging only a few products among large numbers of unwrapped products, since after a production run a number of wrapped products are left in the buffer.

The sequence of the address codes is pre-determined and is maintained via a buffer, the address codes of the products to be wrapped being provided on the products at a different position. This prior art method works according to the so-called first in first out (FIFO) principle.

The object of the invention is to provide a method in which no intermediate stocks are needed, so that the ratio between wrapped and unwrapped products can be chosen randomly.

SUMMARY OF THE INVENTION

To that end, the method according to the invention is characterized in that, for the purpose of avoiding buffers, the order of the products that are formed in the assembly line is such that, allowing for the desired additional operations in the sublines, the products, after traversing the sublines, have acquired the desired order in the downstream line, while the products in the sublines can be temporarily delayed and/or stopped, depending upon the desired order of the output product stream.

Already before being divided over the sublines, the products are assembled in the assembly line in a particular order, so that after the merging of the sublines the products have the desired order sorted according to address code and, for instance, are packaged. This means that the order of the products in which they are assembled before being divided differs from the desired order of the products in the output product stream.

Because the method works without buffers, the ratio between unwrapped and wrapped products can be chosen randomly, for instance, for every thousand unwrapped products a wrapped product can be supplied. Accordingly, no wrapped products are left after a production run, so that the production corresponds to the demand and no waste products are being produced.

The products in the sublines can be temporarily delayed and/or stopped depending upon the desired order of the output product stream; for instance the packaging machine is prevented from producing empty packages when for some time only unwrapped products are being demanded.

In accordance with a preferred method according to the invention for obtaining an output stream of mutually different graphic products in a desired order, for instance sorted according to address code, after the assembly line the product stream is divided over two sublines, with packaging being the additional operation on one subline and the products being passed through untreated on the other subline.

A particularly advantageous method according to the invention is further obtained in that all products are provided with an address code at one position only.

Due to the absence of intermediate buffers, it can suffice, in contrast with the above-described prior art method, to provide the address codes at a single position.

The invention further relates to an apparatus for practising the method according to the invention, comprising an assembling apparatus comprising the assembly line, a divider for dividing the product stream over at least two sublines, and a merging device for merging the products in a downstream line, characterized by a control unit arranged, for the purpose of avoiding buffers, to determine the order of the products which are formed in the assembly line, in such a manner that, allowing for the desired additional operations in the sublines, the products, after traversing the sublines, have acquired the desired order in the downstream line, while the products in the sublines can be temporarily delayed and/or stopped, depending upon the desired order of the output product stream.

By virtue of this set-up, the apparatus is much simpler than an apparatus necessary to practise the above-described prior art method.

The method according to the invention is further explained below with reference to the drawing.

BRIEF DESCRIPTION OF THE DRAWING

The drawing shows a schematic representation of an apparatus for practising the method according to the invention.

DESCRIPTION OF THE PREFERRED EMBODIMENTS

Figure 1:
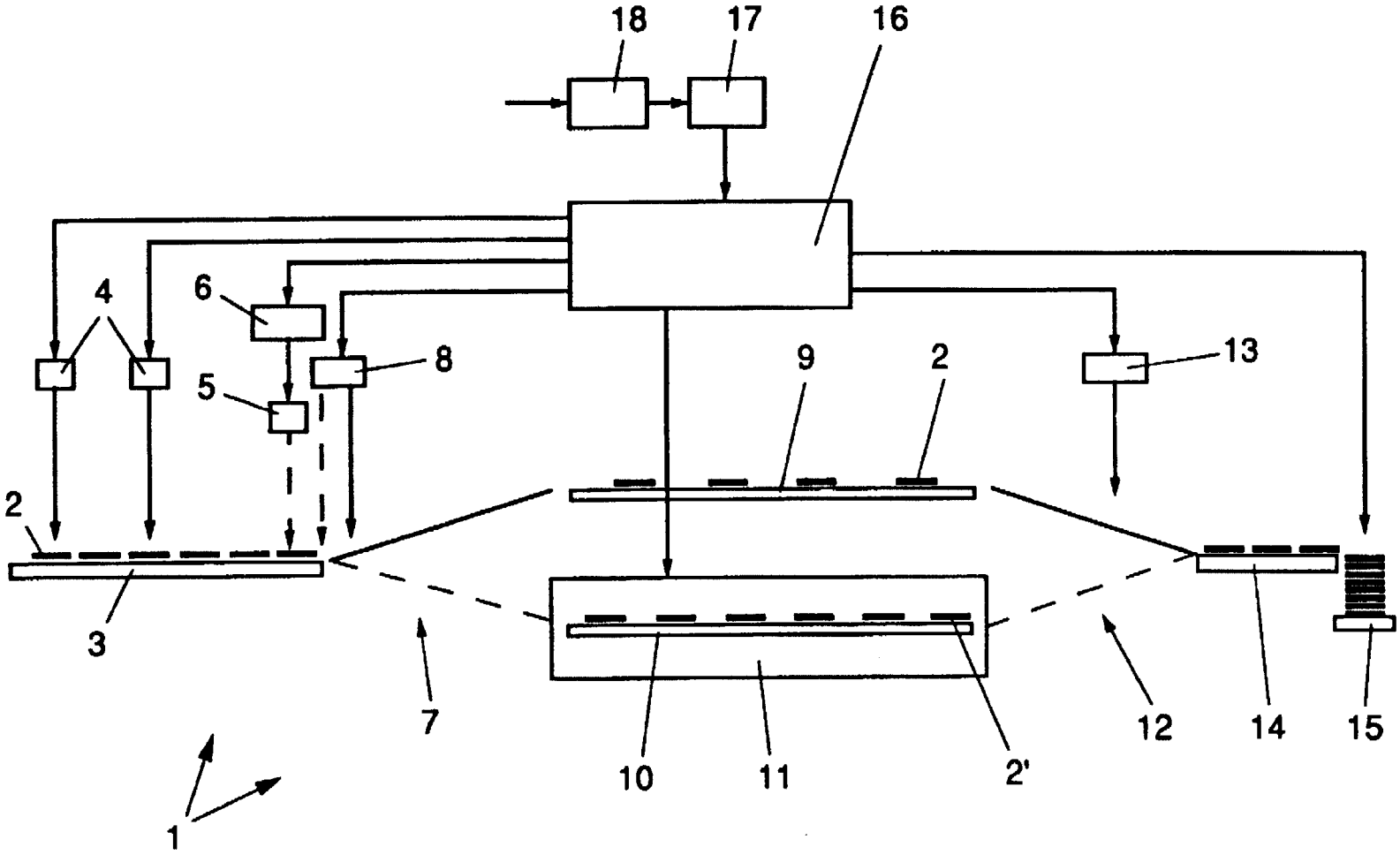

In the first part of the schematically represented apparatus 1, the products 2 are assembled on an assembly line 3 or preliminary line. These products may, for instance, be newspapers, magazines or books, to which a particular enclosure or supplement has been added, depending on the address code. Such demographic editions are assembled in an assembly apparatus 3 in accordance with the wishes of the addressee and/or sender. Such an assembly line or preliminary line is for instance made up of a collation line and/or a bindery line and/or a bonding line.

Using, for instance, a tape or diskette, the address codes are inputted in an input module 18. In a pre-processing unit 17, the order in which the products 2 are to be assembled in the assembly line 3 is determined, depending on the desired sorted order of the output product stream. This order is converted to machine control codes, which define the assembly of and the operations on the products 2. The machine control codes are utilised in a central control unit 16 to actuate the various parts of the apparatus 1.

Reference numerals 4 schematically denote the feeders for selectively feeding an enclosure and the like.

A printer 5 for providing the address code is arranged before a divider 7 for dividing the products over two parallel sublines. The printer 5 is controlled by a first control unit 6, which transmits an address code to be printed to the printer 5, depending upon the desired order of the address codes on the products 2 at the exit of the apparatus 1.

The divider 7 is actuated by a second control unit 8 which, depending on the machine control code of the product 2, leads this product 2 further to a particular subline 9 or 10. In the subline 9 the products 2 are passed further in the direction of the exit by means of a conveyer.

Particular products, however, are to be subjected to a further operation, for instance packaging. These products 2' are led further via the subline 10 through a packaging device 11. These products may for instance be magazines for new subscribers who are offered a present, for instance in the form of a compact disc. The magazine and the compact disc are to be packaged together to avoid loss during dispatch. The addition of such a present, for instance a compact disc, can take place both in the assembly line 3 and in the subline 10.

Beyond the sublines 9 and 10, the products 2, 2' are merged by a merging device 12 to form a single stream again in a single downstream line. The merging device 12 is controlled by a third control unit 13.

The products 2, 2' are now in the desired order sorted according to address code, and are led to a stacker 15 by means of a conveyer 14, whereafter the products 2, 2' are bundled and readied for further dispatch.

The parts of the apparatus 1 are controlled by a central control unit 16. The control unit 16 regulates the assembly of the products 2 in the assembly line, depending on the desired order of the products at the exit of the apparatus 1. The central control unit 16 also controls the first control unit 6, which causes the address codes to be printed on the product 2. The address codes are printed on the products 2 in an order such that after the merging of the sublines 9 and 10 into a single stream, a desired order, sorted according to address code, has been obtained, while the composition of the products may differ per address code.

It is also possible to provide the address codes on the products after the merging of the sublines 9 and 10, for instance by means of address labels or by means of a printer.

The method and apparatus according to the invention are not limited to two sublines. It is also possible, for instance, to use three sublines; in the first subline the products are wrapped in film, in the second subline the products are wrapped in paper, and in the third subline the products are passed on untreated.

To illustrate the invention, a method according to the invention is described with reference to Table 1. In this randomly chosen example, the product series comprises forty books, which are to leave the apparatus according to FIG. 1 as an output product stream in the order (of address codes) 1 through 40. The products with the machine control code 1 are to be wrapped and the products with the machine control code 0 are to remain unwrapped or untreated. It is noted that the real machine control code comprises much more data. The number of books on the subline for unwrapped products is four and the number of products on the subline for wrapping the products is six.

In this example, on the subline "wrapped", initially the products 1, 2, 4, 8, 10, and 14 are arranged, which are first assembled on the assembly line. Then, for the subline "unwrapped", the products 3, 5, 6 and 7 are assembled and placed thereon. The first product 1 is taken from the subline "wrapped" and fed to the downstream line, which means that the product 17 is assembled and fed to the subline "wrapped". The second product 2 is also taken from the subline "wrapped" and, to maintain the flow through the subline "wrapped", product 19 is then assembled and fed to the subline "wrapped". The third product 3 is taken from the subline "unwrapped", so that thereafter product 9 is assembled to maintain the flow through the subline "unwrapped".

In this way, the central control unit 16 determines the order in which the products are to be assembled in the assembly line, depending upon the desired output, before the products are divided over the sublines. The order of the products 1 through 40 corresponds, for instance, with a particular, sorted address code which it is desired to obtain at the exit of the apparatus.

TABLE 1

Example of a production run.

| Desired output | | Subline (10) "wrapped" | | Subline (9) "unwrapped" | | Supply | |
|---|---|---|---|---|---|---|---|
| address code | control code | address number | control code | address number | control code | address number | control code |
| 1 | 1 | 1 | 1 | 3 | 0 | 1 | 1 |
| 2 | 1 | 2 | 1 | 5 | 0 | 2 | 1 |
| 3 | 0 | 4 | 1 | 6 | 0 | 4 | 1 |
| 4 | 1 | 8 | 1 | 7 | 0 | 8 | 1 |
| 5 | 0 | 10 | 1 | 9 | 0 | 10 | 1 |
| 6 | 0 | 14 | 1 | 11 | 0 | 14 | 1 |
| 7 | 0 | 17 | 1 | 12 | 0 | 3 | 0 |
| 8 | 1 | 19 | 1 | 13 | 0 | 5 | 0 |
| 9 | 0 | 22 | 1 | 15 | 0 | 6 | 0 |
| 10 | 1 | 23 | 1 | 16 | 0 | 7 | 0 |
| 11 | 0 | 24 | 1 | 18 | 0 | 17 | 1 |
| 12 | 0 | 25 | 1 | 20 | 0 | 19 | 1 |
| 13 | 0 | 26 | 1 | 21 | 0 | 9 | 0 |
| 14 | 1 | 28 | 1 | 27 | 0 | 22 | 1 |
| 15 | 0 | 29 | 1 | 33 | 0 | 11 | 0 |
| 16 | 0 | 30 | 1 | 34 | 0 | 12 | 0 |
| 17 | 1 | 31 | 1 | 35 | 0 | 13 | 0 |
| 18 | 0 | 32 | 1 | 36 | 0 | 23 | 1 |
| 19 | 1 | 37 | 1 | 39 | 0 | 15 | 0 |
| 20 | 0 | 38 | 1 | | | 24 | 1 |
| 21 | 0 | 40 | 1 | | | 16 | 0 |
| 22 | 1 | | | | | 18 | 0 |
| 23 | 1 | | | | | 20 | 0 |
| 24 | 1 | | | | | 25 | 1 |
| 25 | 1 | | | | | 21 | 0 |
| 26 | 1 | | | | | 27 | 0 |
| 27 | 0 | | | | | 26 | 1 |
| 28 | 1 | | | | | 33 | 0 |
| 29 | 1 | | | | | 28 | 1 |
| 30 | 1 | | | | | 34 | 0 |
| 31 | 1 | | | | | 35 | 0 |
| 32 | 1 | | | | | 29 | 1 |
| 33 | 0 | | | | | 30 | 1 |
| 34 | 0 | | | | | 31 | 1 |
| 35 | 0 | | | | | 32 | 1 |
| 36 | 0 | | | | | 37 | 1 |
| 37 | 1 | | | | | 36 | 0 |

TABLE 1-continued

| | | | |
|---|---|---|---|
| 38 | 1 | 38 | 1 |
| 39 | 0 | 40 | 1 |
| 40 | 1 | 39 | 0 |

| | |
|---|---|
| Production | 40 books |
| Length subline (10), for instance wrapping | 6 books |
| Length subline (9), for instance no wrapping | 4 books |
| Machine control code 1 = wrapping and machine control code 0 = no wrapping. | |

We claim:

1. Method for obtaining an output stream of mutually different graphic products in a desired order, comprising in a pre-processing phase, based on the desired order in the output stream, pre-processing the products in an order in which the graphic products are to be transported through and assembled in an assembly line, in a processing phase, transporting the products through and assembling the products in the assembly line, dividing the products over at least two sublines along which the products are transported with respective variable subline transport speeds, such that in at least one of the sublines the products undergo at least one additional operation, merging the products of the sublines in a single downstream transport line along which the products are transported, and wherein during the processing phase, the respective subline transport speeds are controlled such that the respective sublines and the downstream transport line are completely filled with the products.

2. Method according to claim 1, wherein the products are divided over a first and a second subline, and wherein in the first subline the products are packaged and in the second subline the products are passed on untreated.

3. Method according to claim 1, wherein the products are provided with an address code at one position only.

4. Apparatus comprising an assembly apparatus comprising an assembly line for assembling and transporting graphic products;

at least two sublines in at least one of which the products undergo at least one additional operation, the sublines having speeds of transport which are variable;

a divider for dividing the products from the assembly line over the at least two sublines;

a downstream line;

a merging device for merging the products coming from the respective sublines in the downstream line;

a pre-processing unit for determining in a pre-processing phase an order in which the products are to be transported through and assembled in the assembly line; and a control unit for controlling the speed of transport in the sublines such that the respective sublines and the downstream transport line are completely filled with products.

* * * * *